US011554275B2

(12) United States Patent
Malloy et al.

(10) Patent No.: US 11,554,275 B2
(45) Date of Patent: Jan. 17, 2023

(54) FULL FACE RESPIRATOR

(71) Applicant: JSP LIMITED, Witney (GB)

(72) Inventors: Tom Malloy, Witney (GB); Matthew Judson, Witney (GB); Clive Johnstone, Witney (GB)

(73) Assignee: JSP Limited, Witney (GB)

( * ) Notice: Subject to any disclaimer, the term of this patent is extended or adjusted under 35 U.S.C. 154(b) by 481 days.

(21) Appl. No.: 16/650,769

(22) PCT Filed: Sep. 10, 2018

(86) PCT No.: PCT/GB2018/052568
§ 371 (c)(1),
(2) Date: Mar. 25, 2020

(87) PCT Pub. No.: WO2019/063966
PCT Pub. Date: Apr. 4, 2019

(65) Prior Publication Data

US 2020/0289859 A1 Sep. 17, 2020

(30) Foreign Application Priority Data

Sep. 26, 2017 (GB) ..... 1715583

(51) Int. Cl.
*A62B 18/02* (2006.01)
*A62B 7/10* (2006.01)
(Continued)

(52) U.S. Cl.
CPC ..... *A62B 18/02* (2013.01); *A62B 7/10* (2013.01); *A62B 9/04* (2013.01); *A62B 18/084* (2013.01);
(Continued)

(58) Field of Classification Search
CPC .. A62B 18/02; A62B 7/10; A62B 9/04; A62B 18/084; A62B 18/10; A62B 18/00
See application file for complete search history.

(56) References Cited

U.S. PATENT DOCUMENTS 2,381,568 A * 8/1945 Booharin ..... A62B 18/02 128/201.15
2,741,246 A * 4/1956 Litchfield ..... A62B 18/02 128/201.13
(Continued)

FOREIGN PATENT DOCUMENTS

GB 2268076 A 1/1994
GB 2511996 A 9/2014
(Continued)

OTHER PUBLICATIONS

International Search Report and Written Opinion issued in PCT/GB2018/052568, dated Nov. 21, 2018, 11 pages.
(Continued)

*Primary Examiner* — Tu A Vo
(74) *Attorney, Agent, or Firm* — Faegre Drinker Biddie & Reath LLP

(57) ABSTRACT

A full face respirator comprising a mask (10) having a transparent viewing portion (12) and a port portion (16), and exhalation port (22) disposed in said port portion (16), a face seal configured (14) to seal the mask (10) over a wearer's eyes, nose and mouth, in use, and an orinasal assembly (2) including a flexible, cup-shaped orinasal (2) having an orifice (2*a*) and being configured to fit over a wearer's nose and mouth, in use; wherein the orinasal assembly (2) further includes generally tubular connecting portion (24), integrally formed with and extending outwardly from the periphery of the orifice (2*a*), the connection portion (24) being shaped and configured to extend through the exhalation port (22) from the inner region to the outer region of the
(Continued)

mask (10) and including an exhalation valve mount (28) for receiving a one-way exhalation valve (4).

10 Claims, 2 Drawing Sheets

(51) Int. Cl.
*A62B 9/04* (2006.01)
*A62B 18/10* (2006.01)
*A62B 18/08* (2006.01)

(52) U.S. Cl.
CPC ..... *A62B 18/10* (2013.01); *A62B 18/08* (2013.01); *A62B 18/082* (2013.01)

(56) References Cited

U.S. PATENT DOCUMENTS 4,574,799 A * 3/1986 Warncke ..... A62B 18/02 128/207.12
5,924,420 A * 7/1999 Reischel ..... A62B 18/082 128/206.28
6,176,239 B1 * 1/2001 Grove ..... A62B 18/02 128/201.15
2002/0092522 A1 * 7/2002 Fabin ..... A62B 17/04 128/205.27
2003/0047183 A1 * 3/2003 Kiefer ..... A62B 18/082 128/201.15
2007/0235032 A1 * 10/2007 Betz ..... A62B 18/082 128/205.27
2010/0065058 A1 * 3/2010 Ungar ..... A62B 18/02 128/206.24
2010/0258131 A1 * 10/2010 Gaffney ..... A62B 18/08 29/428
2016/0129286 A1 * 5/2016 Danford ..... A62B 18/02 128/206.21

FOREIGN PATENT DOCUMENTS

WO 1998013103 A1 4/1998
WO 2002011816 A1 2/2002
WO 2016112434 A1 7/2016

OTHER PUBLICATIONS

Search Report issued in GB Patent Application No. GB1715583.9, completed on Mar. 13, 2018, 1 page.

* cited by examiner

FULL FACE RESPIRATOR

CROSS-REFERENCE TO RELATED APPLICATION

This application is a U.S. 371 National Stage Application of International Application No. PCT/GB2018/052568, filed Sep. 10, 2018, which claims the benefit of Great Britain Application No. GB 1715583.9, filed Sep. 26, 2017, both of which are herein incorporated by reference in their entireties.

FIELD OF THE INVENTION

This invention relates generally to a full face respirator for providing a user with a breathable air supply within an environment that may be contaminated with harmful or irritating gases or other substances.

BACKGROUND OF THE INVENTION

WO98/13103 describes a full face respirator comprising a face shield, including a transparent viewing portion and a face seal for sealing the face shield over a user's face, in use. The face shield comprises upper and lower frame members, the lower frame member including a port portion located below the transparent viewing portion. The port portion includes a pair of air intake ports, each having a connector for receiving a filter cartridge, and a central exhalation port. A nose cup or orinasal is provided, which fits over a user's nose and mouth in use and includes a central orifice having circumferential connecting regions on the inner rim thereof. The full face respirator further comprises a centre adapter comprising a base having a generally cylindrical end portion on which a gasket is fitted. The base is configured to receive an exhalation valve, and connecting members are provided on the outer wall of the cylindrical end portion. When it is required to assemble the device, the cylindrical end portion is inserted through the central exhalation port (to the inner region of the mask) and is received within the central orifice of the orinasal, the connecting members of the cylindrical end portion of the base thus engaging with the connecting regions on the inner rim of the central orifice of the orinasal to releasably connect the base (including the exhalation valve) to the orinasal at the inner region of the mask such that the exhalation valve is located outside the mask against the periphery of the central exhalation port. A protective cover is removably mounted over the exhalation valve.

Full face respirators of this type have been in widespread use for many years by, for example, firefighters, military personnel and industrial/construction operatives, where a clean air supply is required because the surrounding environment may be contaminated with toxic substances. In addition to supplying a clean air supply, such full face respirators include a mask that provides a seal around the entire face with a flexible face seal to protect both the eyes and the face from the potentially toxic substances.

However, there are a number of issues associated with known full face respirators. Firstly, most full face respirators, including those of the type described above, are designed to be disassembled for cleaning and maintenance purposes. However, re-assembling such devices for use can be difficult to achieve efficiently. The internal connecting or mounting points in the rim of the orinasal, and the flexibility of the orinasal structure at the location of its central orifice, can make the task of re-connecting the base (and exhalation valve assembly) to the orinasal fiddly. This process usually results in repeated deformation of the orinasal, which in turn can lead to premature failure. Even prior to complete failure thereof, it may become warped, leading to a loss of its correct and intended shape, which results in poor face fitment, increased breathing resistance and/or greater risk of inward leakage.

It is an object of aspects of the present invention to address at least some of these issues.

SUMMARY OF THE INVENTION

In accordance with a first aspect of the present invention, there is provided a full face respirator comprising a mask having a transparent viewing portion and a port portion, an exhalation port disposed in said port portion, a face seal configured to seal the mask over a wearer's eyes, nose and mouth, in use, and an orinasal assembly comprising a flexible, cup-shaped orinasal having an orifice and being configured to fit over a wearer's nose and mouth, in use; wherein the orinasal assembly further comprises a generally tubular connecting portion, integrally formed with and extending outwardly from the periphery of said orifice, said connecting portion being shaped and configured to extend through said exhalation port from the inner region to the outer region of the mask and including an exhalation valve mount for receiving a one-way exhalation valve.

Thus, the connection between the orinasal and the mask at the location of the exhalation valve is effected simply by inserting the connecting portion through the exhalation port, from the inner region to the outer region of the mask, eliminating the internal connecting points and making the re-assembly process less fiddly in comparison with prior art devices.

In an exemplary embodiment, a sealing gasket is provided around the outer wall of the connecting portion, adjacent to the orifice of the orinasal, for sealing the orinasal against the periphery of the exhalation port.

The connecting portion and the inner peripheral wall or rim of the exhalation port may comprise integral cooperative connecting members for removably affixing the orinasal assembly to the exhalation port (and, therefore, the mask). The connecting members may comprise male and female portions respectively of a twist bayonet connection mechanism between the connecting portion and the exhalation port. The male and female portions of the twist bayonet connection mechanism may be integrally formed in or on the inner wall/rim of the exhalation port and the outer wall of the connecting portion of the orinasal assembly respectively. In an exemplary embodiment, the female portion of the twist bayonet connection mechanism may be integrally formed on the outer wall of the connecting portion of the orinasal assembly and the male portion thereof may be formed on the inner wall or rim of the exhalation port. This type of connection mechanism, provided within the exhalation port and configured to engage with the connecting portion of the orinasal assembly, is considered particularly beneficial as it provides a positive and intuitive connection mechanism between the parts, resulting in increased ease of disassembly for cleaning and subsequent re-assembly for use.

In an exemplary embodiment, the connecting portion of the orinasal assembly is substantially rigid, and the cup-shaped orinasal is resiliently flexible (to provide a good and comfortable seal over the user's nose and mouth). The rigidity of the connecting portion makes the disassembly and subsequent assembly processes much easier and less fiddly, and avoids undue deformation of the cup-shaped orinasal, thus preventing warping and premature failure thereof. The connecting portion may, for example, comprise a moulded hard polypropylene (PP) copolymer (or similar), with the female portion of the twist bayonet connection mechanism being integrally moulded thereon, and the cup-shaped orinasal may be formed of a flexible rubber (e.g. Thermoplastic Polyurethane or TPU), with which the connecting portion is overmoulded. As a result, the respirator provides a more robust and solid assembly, compared with prior art devices, and the orinasal body retains its correct and intended shape, irrespective of repeated disassembly and re-assembly, thus providing a better face fitment, lower breathing resistance and less inward leakage over time.

In an exemplary embodiment, the port portion of the respirator may comprise at least one, and more preferably two, air intake ports, each air intake port comprising a connector for removably receiving thereon a filter cartridge assembly. The cup-shaped orinasal may comprise at least one aperture or opening adjacent the or each air intake port, when the respirator is assembled for use. The at least one aperture may have mounted or formed therein an inhalation valve mount for receiving thereon a one-way inhalation valve. The respirator may also include a strap or harness assembly for securing the mask over a user's face in use. The harness or strap assembly may be removably connected to the mask.

In accordance with a second aspect of the present invention, there is provided an orinasal assembly for a full face respirator substantially as described above, comprising a flexible, cup-shaped orinasal having an orifice and being configured to fit over a wearer's nose and mouth, in use; wherein the orinasal assembly further comprises a generally tubular, substantially rigid connecting portion, integrally formed with and extending outwardly from the periphery of said orifice, said connecting portion including an exhalation valve mount for receiving a one-way exhalation valve.

In accordance with a third aspect of the present invention, there is provided a kit of parts for a full face respirator, comprising an orinasal assembly substantially as described above, a mask having a transparent viewing portion and a port portion, an exhalation port disposed in said port portion, a face seal configured to seal the mask over a wearer's eyes, nose and mouth, in use, said connecting portion of said orinasal assembly being shaped and configured to extend through said exhalation port from the inner region to the outer region of the mask and including an exhalation valve mount for receiving a one-way exhalation valve, wherein a connection mechanism is provided in or on the connecting portion of the orinasal assembly and or the exhalation port to releasably affix the orinasal assembly to the mask.

These and other aspects of the present invention will become apparent from the following specific description.

BRIEF DESCRIPTION OF THE DRAWINGS

An embodiment of the present invention will now be described, by way of example only, and with reference to the accompanying drawings, in which.

DETAILED DESCRIPTION

Figure 1:
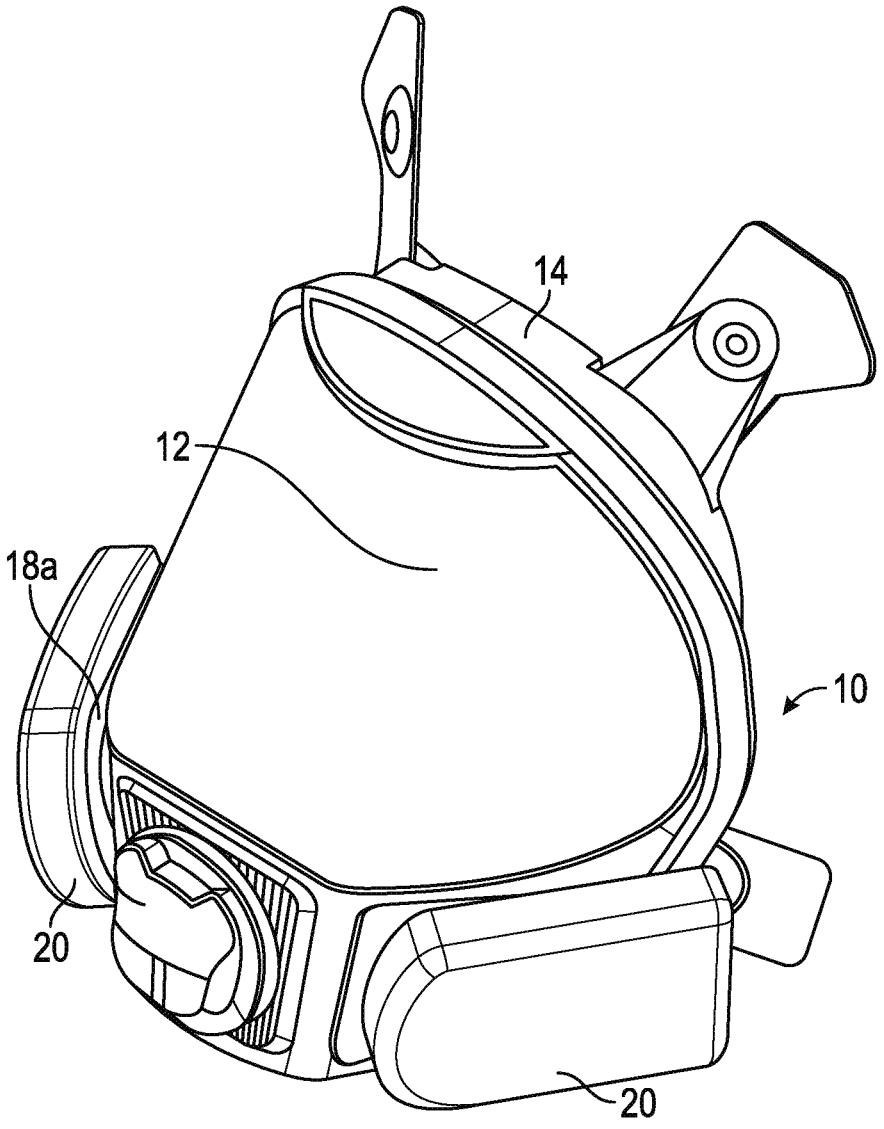
FIG. 1 is a schematic front perspective view of a full face respirator according to an exemplary embodiment of the present invention, when assembled for use.
Figure 2:
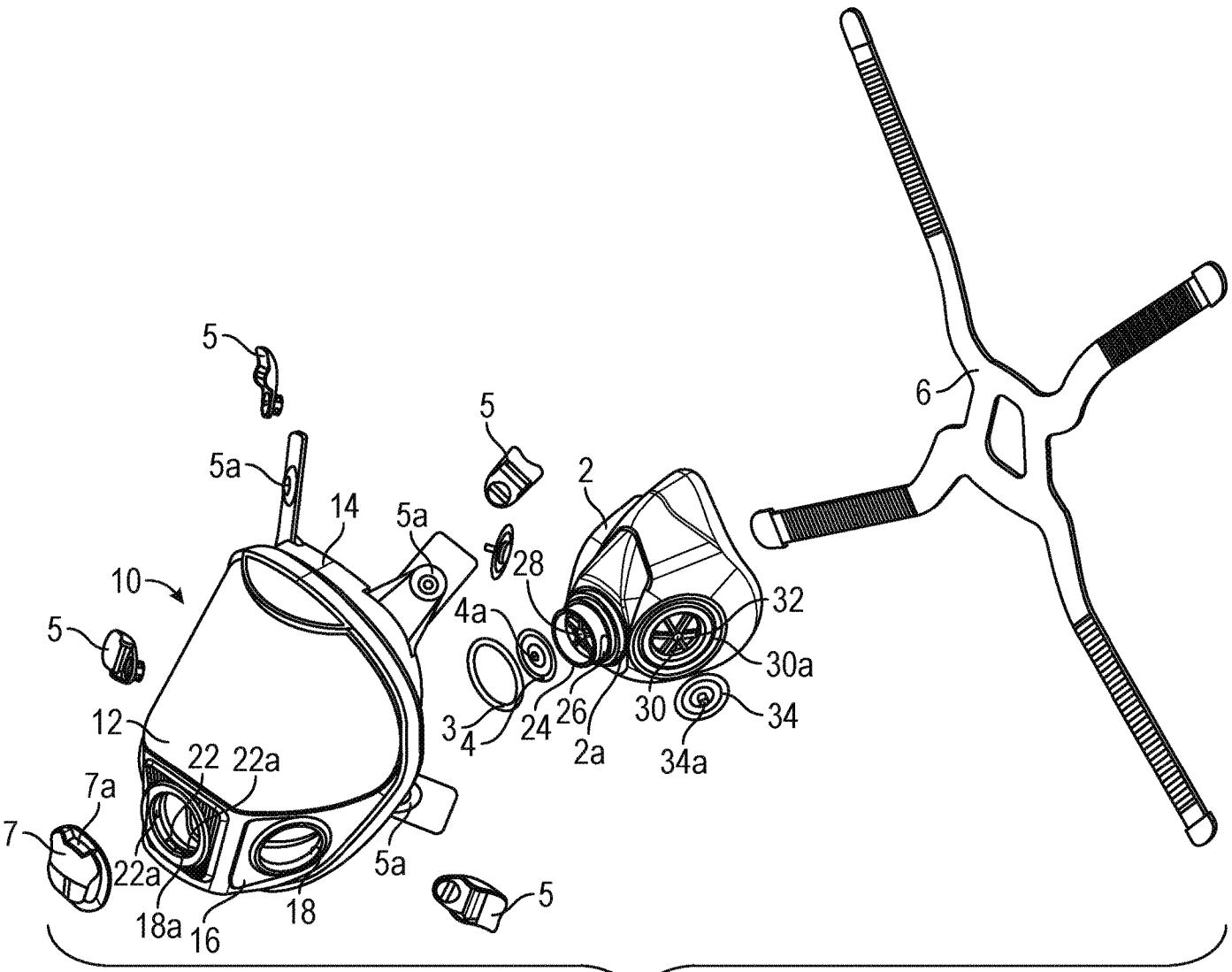
FIG. 2 is an exploded view of the full face respirator of FIG. 1, excluding the filter cartridges, illustrating the manner in which the respirator can be disassembled.

Referring to FIGS. 1 and 2 of the drawings, a full face respirator according to an exemplary embodiment of the present invention comprises a face shield or mask 10, including a transparent viewing portion 12 and a face seal 14 for sealing the mask 10 over a user's face, in use. The mask 10 comprises a port portion 16 located below the transparent viewing portion 12 when viewed from a front elevation (when the respirator is oriented for use). The port portion 16 includes a pair of intake ports 18 (only one can be seen in FIG. 2), each having a connector region 18*a* for receiving a filter cartridge 20, and a generally central exhalation port 22.

A nose cup or orinasal 2 is provided, which fits over a user's nose and mouth, in use, and includes a central orifice defined by peripheral rim 2*a*. The orinasal 2 is formed of a flexible rubber material, such as Thermoplastic Polyurethane (TPU) although the present invention is not necessarily strictly limited in this regard. The orinasal 2 comprises an integral connecting portion 24, comprising a generally tubular, substantially rigid member that extends outwardly from the peripheral rim 2*a* of the orinasal orifice. The connecting portion is moulded of a hard plastic material, such as hard polypropylene (PP) copolymner, although the present invention is not necessarily strictly intended to be limited in this regard. The hard plastic connecting portion 24 is, in a preferred exemplary embodiment of the present invention, overmoulded with the flexible rubber orinasal orifice 2*a* to provide a robust and solid assembly.

The outer wall of the connecting portion 24 includes integrally moulded female connecting regions 26. In the illustrated example, three such female connecting regions 26 are provided (although only one can be seen in FIG. 2 of the drawings): two being on diametrically opposing side locations on the outer wall of the connecting portion, and a third being located between them on the lower wall of the connecting portion 24 (when the respirator is oriented for use).

An exhalation valve frame member 28 is integrally moulded or otherwise mounted within the tubular connecting portion 24, adjacent to, and concentric with, the orinasal orifice 2*a*. The exhalation valve frame member 28 comprises a generally circular, hard plastic outer rim and a concentric inner circular portion having a small central aperture. Radial ribs extend between the outer rim and the inner circular portion. A one-way exhalation valve 4, in the form of a flexible diaphragm, is mounted within the connecting portion 24 by inserting a pin 4*a* thereof through the small central aperture in the exhalation valve frame member 28.

A gasket 3 (or "o-ring"), which may be formed of any suitable resiliently flexible material such as rubber or silicone, is mounted over the connecting portion 24 and sits against the proximal end thereof, adjacent the orinasal orifice 2*a*.

In order to assemble the respirator, the connecting portion 24, including the exhalation valve 4 and the gasket 3, is inserted through the exhalation port 22 of the mask 10 from the rear to the front (when the respirator is oriented for use). The inner wall of the exhalation port 22 is integrally formed with three male connecting regions 22*a* (only two can be seen in FIG. 2), which correspond in relative location to the female connecting regions 26 on the connecting portion 24. It will be appreciated that the outer diameter of the connecting portion 24 is substantially the same as (or very slightly smaller than) the inner diameter of the exhalation port 22, such that the connecting portion 24 can be inserted into the exhalation port 22 in a snug fit and, due to the slightly raised male connector regions 22*a*, it can only be inserted through the exhalation port 22 if the female connector regions 26 on the connecting portion 24 are aligned with the male connector regions 22*a* on the inner wall of the exhalation port 22. The female connecting regions 26 on the connecting portion 24 and the male connector regions 22*a* on the inner wall of the exhalation port 22, together, form a twist bayonet connection mechanism between the connecting portion 24 and the exhalation port 22. Thus, once the connecting portion 24 is fully inserted through the exhalation port 22, it can be twisted relative thereto to engage the female and male connecting regions 26, 22*a* and lock the orinasal assembly to the mask 10. Of course, in alternative exemplary embodiments, the female connecting regions may be provided on the inner wall of the exhalation port 22 and the male connector regions may be provided at corresponding locations on the outer wall of the connecting portion 24. Alternative suitable connection mechanisms may also be envisaged, and will be known to a person skilled in the art.

A cover 7. Having opening s7*a* therein, is removably mounted (e.g. in a snap fit) over the front of the exhalation port 22 to protect the exhalation valve 4 and prevent the ingress of particulate matter from the external environment.

The orinasal 2 comprises a pair of intake apertures 30, one on each side of the central orifice 2*a* (only one intake aperture can be seen in the view of FIG. 2). An inhalation valve frame member 32 is moulded or otherwise mounted within each of the intake apertures 30, and each inhalation valve frame member again comprises a pair of radially spaced-apart concentric circular members, with a small central aperture and radial ribs extending between the circular members. A one-way inhalation valve 34, in the form of a flexible diaphragm, is mounted in each intake aperture 30 by inserting a pin 32*a* thereof through the small central aperture of a respective inhalation valve frame member 32. The outer rim 30*a* of each intake aperture 30 is configured to engage with a respective intake port 18 in the mask 10 to define a sealed air flow path, in use, between the inside of the orinasal 2 and the respective filter cartridge 20.

A harness or strap 6 is removably affixed to the mask 10 (at four points 5*a*, only three shown in the view of FIG. 2) by means of harness clips 5, to enable the respirator to be secured to a user's head in use.

It will be apparent to a person skilled in the art, from the foregoing description, that modifications and variations can be made to the described embodiments without departing from the scope of the invention as defined by the appended claims.

The invention claimed is:

1. A full face respirator comprising a mask having a transparent viewing portion and a port portion, an exhalation port disposed in said port portion, wherein the port portion of the mask further comprises a pair of air intake ports, wherein each of the pair of air intake ports comprising a connector for removably receiving thereon a filter cartridge; a face seal configured to seal the mask over a wearer's eyes, nose and mouth, in use, and an orinasal assembly comprising a flexible, cup-shaped orinasal having an orifice and being configured to fit over a wearer's nose and mouth, in use; wherein the orinasal assembly further comprises a generally tubular connecting portion extending outwardly from a periphery of said orifice, said connecting portion being shaped and configured to extend through said exhalation port from an inner region to an outer region of the mask and including an exhalation valve mount for receiving a one-way exhalation valve; wherein the connecting portion is integrally formed with the orifice of the orinasal assembly; and the cup-shaped orinasal comprises a pair of inlet aperture or opening forming portions, each of the pair of inlet aperture or opening forming portions comprising an inlet aperture or opening, wherein each of the inlet aperture or opening is adjacent to each of the air intake port, each of the inlet aperture or opening forming portions having an outer rim configured to engage with a respective air intake port of the pair of air intake ports in the mask to define a sealed air path between an inside of the orinasal and a respective filter cartridge of the pair of filter cartridges when the respirator is assembled for use, and wherein each of the inlet aperture or opening forming portions comprising an inhalation valve frame member configured to support an inhalation valve.

2. A full face respirator according to claim 1, wherein a sealing gasket is provided around an outer wall of the connecting portion, adjacent to the orifice of the orinasal assembly, for sealing the orinasal assembly against a periphery of the exhalation port.

3. A full face respirator according to claim 1, wherein the connecting portion and an inner peripheral wall or rim of the exhalation port comprise integral cooperative connecting members for removably affixing the orinasal assembly to the exhalation port.

4. A full face respirator according to claim 3, wherein the connecting members comprise a male portion and a female portion respectively of a twist bayonet connection mechanism between the connecting portion and the exhalation port.

5. A full face respirator according to claim 4, wherein the male portion and female portion of the twist bayonet connection mechanism are integrally formed in or on the inner peripheral wall or rim of the exhalation port and an outer wall of the connecting portion of the orinasal assembly respectively.

6. A full face respirator according to claim 1, wherein the connecting portion of the orinasal assembly is substantially rigid, and the cup-shaped orinasal is resiliently flexible.

7. A full face respirator according to claim 6, wherein the connecting portion comprises a moulded hard polypropylene (PP) copolymer and the cup-shaped orinasal is formed of a flexible rubber material with which the connecting portion is overmoulded.

8. A full face respirator according to claim 1, further comprising a strap or harness assembly for securing the mask over a user's face in use.

9. A full face respirator according to claim 8, wherein the harness or strap assembly is removably connected to the mask.

10. A kit comprising:

a mask having a transparent viewing portion and a port portion, an exhalation port disposed in said port portion, wherein the port portion of the mask further comprises a pair of air intake ports, wherein each of the pair of air intake ports comprising a connector for removably receiving thereon a filter cartridge; a face seal configured to seal the mask over a wearer's eyes, nose and mouth, in use, an orinasal assembly comprising a flexible, cup-shaped orinasal having an orifice and being configured to fit over a wearer's nose and mouth, in use; wherein the orinasal assembly further comprises a generally tubular connecting portion extending outwardly from a periphery of said orifice, said connecting portion being shaped and configured to extend through said exhalation port from an inner region to an outer region of the mask and including an exhalation valve mount for receiving a one-way exhalation valve; wherein the connecting portion is integrally formed with the orifice of the orinasal assembly; and the cup-shaped orinasal comprises a pair of inlet aperture or opening forming portions, each of the pair of inlet aperture or opening forming portions comprising an inlet aperture or opening, wherein each of the inlet aperture or opening is adjacent to each of the air intake port, each of the inlet aperture or opening forming portions having an outer rim configured to engage with a respective air intake port of the pair of air intake ports in the mask to define a sealed air path between an inside of the orinasal and a respective filter cartridge of the pair of filter cartridges when the respirator is assembled for use, and wherein each of the inlet aperture or opening forming portions comprising an inhalation valve frame member configured to support an inhalation valve, and a connection mechanism is provided in or on the connecting portion of the orinasal assembly and or the exhalation port to releasably affix the orinasal assembly to the mask.

* * * * *